US006126750A

United States Patent [19]

Seiz et al.

[11] Patent Number: 6,126,750

[45] Date of Patent: Oct. 3, 2000

[54] DEVICE USED TO INDIRECTLY APPLY A LIQUID OR VISCOUS MEDIUM ONTO A MATERIAL WEB, SPECIFICALLY A PAPER OR CARDBOARD WEB

[75] Inventors: Roland Seiz, Steimel, Germany; Michael Trefz, Appleton, Wis.

[73] Assignee: Voith Sulzer Papiertechnik Patent GmbH, Heidenheim, Germany

[21] Appl. No.: 09/196,671

[22] Filed: Nov. 19, 1998

[30] Foreign Application Priority Data

Nov. 21, 1997 [DE] Germany ..... 197 51 697

[51] Int. Cl.[7] ..... B05C 11/02; B05C 1/00; B05C 1/06; B05C 3/02; D21F 11/00

[52] U.S. Cl. ..... 118/118; 118/261; 118/413; 118/249; 118/126; 162/204

[58] Field of Search ..... 118/261, 413, 118/249, 118, 126, 101, 202; 162/204

[56] References Cited

U.S. PATENT DOCUMENTS

| | | | |
|---|---|---|---|
| Re. 31,695 | 10/1984 | Zink | 427/211 |
| 3,029,779 | 4/1962 | Hornbostel | 118/104 |
| 3,152,918 | 10/1964 | Kraus | 117/63 |
| 3,203,392 | 8/1965 | Edwards | 118/115 |
| 3,701,335 | 10/1972 | Barnscheidt | 118/104 |
| 3,785,340 | 1/1974 | Stafford et al. | 118/101 |
| 4,856,454 | 8/1989 | Sieberth et al. | 118/126 |
| 5,219,618 | 6/1993 | Daniels | 427/356 |

FOREIGN PATENT DOCUMENTS

| | | | |
|---|---|---|---|
| 8 07 746 | 7/1949 | Germany . | |
| 20 34 004 | 9/1978 | Germany | B05C 11/02 |
| 36 33 833 C1 | 12/1987 | Germany | B05D 1/40 |
| 40 32 838 A1 | 5/1991 | Germany | B05C 11/04 |
| 40 08 712 A1 | 9/1991 | Germany | B41F 15/42 |
| 43 02 435 A1 | 8/1993 | Germany | D21H 23/56 |
| 42 43 518 A1 | 1/1994 | Germany | B05C 1/08 |
| WO 93/05887 | 4/1993 | WIPO | B05C 11/04 |

*Primary Examiner*—Stanley S. Silverman
*Assistant Examiner*—Dionne A. Walls
*Attorney, Agent, or Firm*—Taylor & Aust, P.C.

[57] ABSTRACT

A device for indirect application of a liquid or viscous medium onto a traveling material web, specifically a paper or cardboard web, includes an applicator device for the application of a layer of liquid or viscous medium onto a surface of a transfer element. The transfer element is in contact with the moving material web and transfers the coating onto the web. A leveling unit is equipped with a leveling element positioned against the material web for smoothing of the coating layer on the material web. The leveling element is mounted rigidly in cross direction to the material web, that is, in a direction substantially orthogonal and in a local material web progression to the direction of travel of the material web.

16 Claims, 1 Drawing Sheet

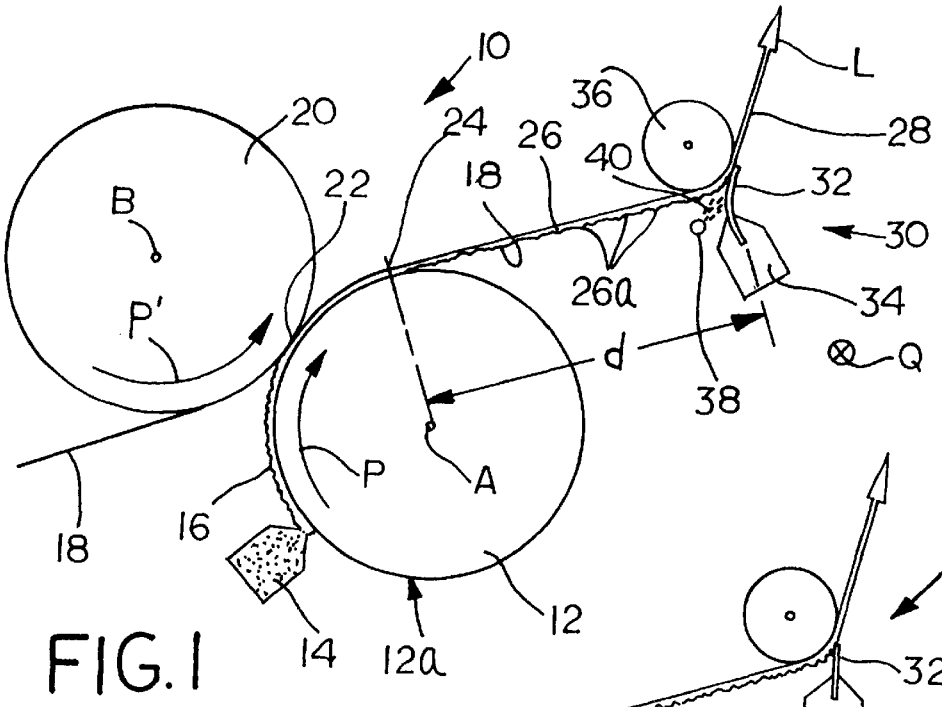
FIG.1
FIG.2
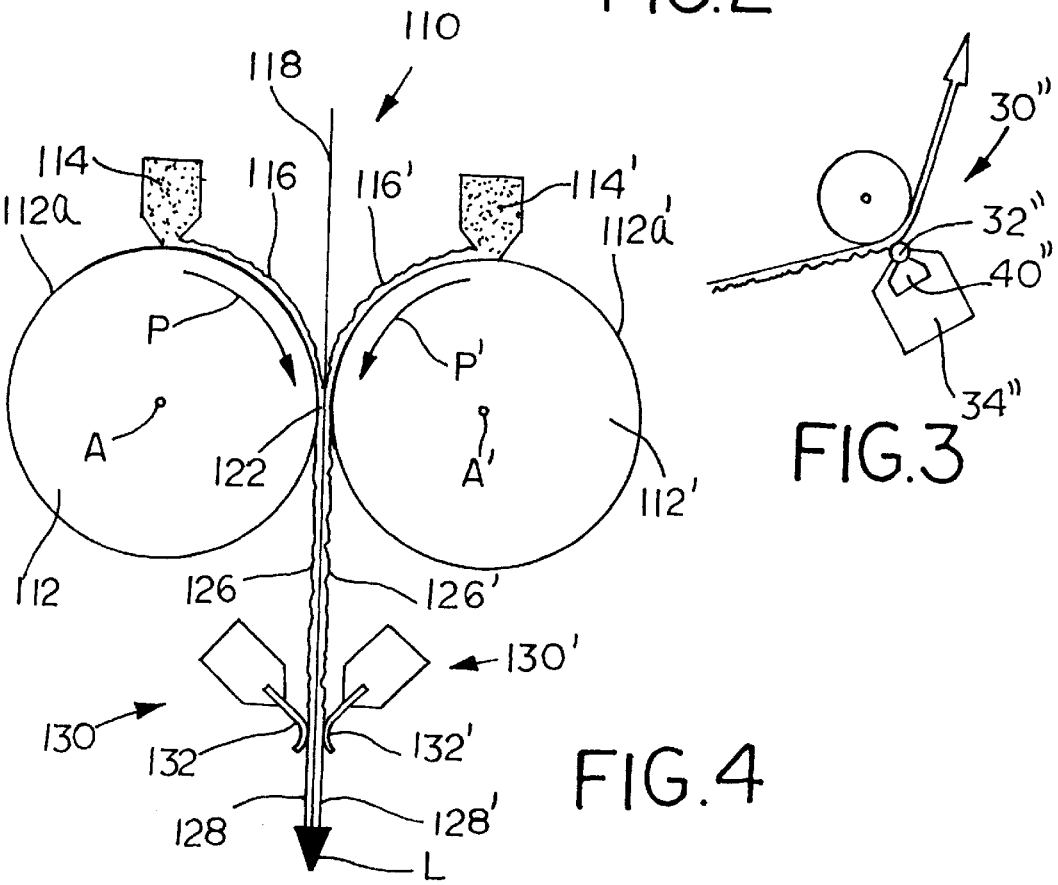
FIG.3
FIG.4

DEVICE USED TO INDIRECTLY APPLY A LIQUID OR VISCOUS MEDIUM ONTO A MATERIAL WEB, SPECIFICALLY A PAPER OR CARDBOARD WEB

BACKGROUND OF THE INVENTION

1. Field of the Invention

The present invention relates to a device for indirect application of a liquid or viscous medium onto a moving material web, specifically a paper or cardboard web.

2. Description of the Related Art

Devices for indirect application of a medium onto a moving web are known, for example, from German Patent Documents DE 43 02 435 A1 and DE 42 43 518 A1. The units described in these two documents utilize spreading rolls in processing the still moist coating layer in order to smooth surface roughness from the coating layer. Such surface roughness occurs due to the so-called "film-splitting" effect when the material web separates from the transfer element. In order to achieve the spreading movement, these spreading rolls, which are mounted transversely to the material web, are driven rotationally around their axis. Due to an additional drive, the spreading rolls perform an oscillating movement. The necessity of having to combine the movements of the spreading rolls conforming to two degrees of freedom of motion leads to a structurally expensive design in the known applicator unit. The movement necessary to position the leveling device to the material web, and the drive mechanism necessary to produce this movement, had not even been considered yet.

SUMMARY OF THE INVENTION

The present invention provides a generic applicator unit having a structurally simpler leveling unit while achieving a highly satisfactory smoothing result in practical application. The present invention provides an applicator device for the application of a layer of liquid or viscous medium to the surface of a transfer element which is in contact with the moving material web and which transfers the coating onto this web. A leveling unit is equipped with a leveling element which is positioned against the material web for smoothing the coating layer on the material web. The leveling element is mounted rigidly in cross direction to the material web, that is, in a direction substantially orthogonal and in a local material web progression to the direction of flow of the material web. With the leveling device design of the present invention, at least one of the previously necessary drive mechanisms is no longer required, resulting in a corresponding simplification of the design.

The leveling unit may, for example, include a metering rod having a substantially smooth surface. The metering rod may be rotationally driven, i.e., it may be a revolving doctor.

A leveling unit that, with the exception of the drive mechanism for positioning of the leveling element against the material web, does not require another drive mechanism can, for example, be arranged so that the leveling unit includes a doctor blade that can be positioned on the web consistent with a dragging doctor. This may be essentially a "stiff blade" or a doctor blade that deflects on contact with the web, a so-called "bent-blade".

With regard to an applicator unit design that is as simple as possible, the leveling unit smooths the coating layer substantially without removing coating. This will help avoid recirculation or processing stations for removed coating medium.

In order to be able to provide defined smoothing conditions, the web is supported in the area of the leveling unit by a support element, preferably in the form of a backing roll.

To prevent contamination at the leveling element, the leveling device includes a cooling device for the leveling element and its mounting device. This ensures that the leveling element is always covered by the condensate film, preventing adhesion of any contamination. In addition, or alternatively, a moistening unit may be provided for moistening of the leveling element by spraying small amounts of steam onto the leveling element in order to facilitate the forming of a condensate film on the leveling element.

To ensure that the leveling element can have an effect on a still moist coating layer, the leveling unit can be located a maximum of 400 cm, but preferably between approximately 50 cm and 200 cm after the point at which the contact between the material web and the transfer element is concluded. The travel time of the material web between the transfer element and the leveling unit should be between approximately 0.01 second and 1 second.

In order to ensure the transfer of the medium that is applied to the surface of the transfer element is as complete as possible, the transfer element is in the form of a transfer roll and the material web wraps around the circumference of the transfer roll, at least partially. The contact of the coating medium with the material web can be further improved by providing an opposing element, preferably a backing roller on the side of the material web facing away from the transfer element, whereby the line pressure force between the transfer element and the opposing element is approximately between 2 kN/m and 30 kN/m.

The device according to the invention may also be used for the application of liquid or viscous medium to both sides of the web. For this purpose, the opposing element is designed as an additional transfer element to indirectly apply liquid or viscous medium. An additional leveling device can be provided downstream from the additional transfer element, whereby preferably the two leveling elements alternatively form the support element for the other leveling element.

The coating weight per material web side may be, for example, approximately between 3 $g/m^2$ and 25 $g/m^2$, and preferably approximately between 8 $g/m^2$ and 16 $g/m^2$. The coating medium may include minerals such as kaolin, calcium carbonate and titanium dioxide, and organic special additives such as, for example, plastic/resin pigments or capsules. The solids content of the coating medium is between approximately 20% and 70%, and preferably between approximately 40% and 65%. "Solids content" is defined herein as the volume of the aforementioned solids relative to the total volume of the coating medium, with the coating medium being made up from solids and carrier fluid, i.e., water. Paper coated by the applicator unit of the invention has a basis weight of between approximately 30 $g/m^2$ and approximately 500 $g/m^2$.

The smoothing result depends upon the line pressure force with which the leveling element is pressed against the material web, as well as upon the traveling speed of the web. The reason for this is that the width of the smoothing nip between the web surface and the leveling element results from the exchange cycle between the contact pressure of the leveling element and hydrodynamic pressure of the coating medium that builds up prior to the leveling element.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein:

FIG. 1 is a schematic view of a first embodiment of an applicator device according to the present invention, equipped with one embodiment of a downstream leveling device;

FIG. 2 is a schematic view of another embodiment of a leveling device of the present invention;

FIG. 3 is a schematic view of yet another embodiment of a leveling device of the present invention; and FIG. 4 is a schematic view of another embodiment of an applicator device in accordance with the invention, for coating application onto both sides of a material web.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF TEE INVENTION

Referring now to the drawings and particularly to FIG. 1, there is shown an applicator device in accordance with the invention, generally identified with 10. It includes a transfer roll 12 onto the surface 12*a* of which a layer of liquid or viscous medium 16 is applied by an applicator unit 14. The transfer roll 12 rotates around an axis A in direction of arrow P. As a result of the rotation of transfer roll 12, the coating medium 16 is brought to a material web 18 which is traveling in direction L and which wraps partially around the circumference of the transfer roll 12.

A support or backing roll 20 is provided on the side of material web 18 which faces away from the transfer roll 12. It rotates around axis B in direction of arrow P', that is, in opposite direction to transfer roll 12. Transfer roll 12 and back-up roll 20 form a transfer nip 22 in which the liquid or viscous medium 16 is brought into contact with, and transferred onto material web 18. To improve contact of coating medium 16 with the material web 18, the web path is preferably guided over and around a part of the circumference of transfer roll 12 following transfer nip 22, prior to separating from it at 24.

Ideally, the applied layer 26 of coating medium 16 separates from surface 12*a* together with the material web 18, substantially without residue from the surface 12*a* of the transfer roll 12. However, unevenness 26*a* in the applied layer 26 occurs due to the "film splitting" effect.

A leveling unit 30 is provided a distance d measured from the separation point 24 in web travel direction L, following the transfer roll 12. In the embodiment illustrated in FIG. 1, the leveling unit 30 includes a flexible doctor blade 32, also referred to as "bent-blade", which is positioned against the material web 18, and specifically against the coating layer 26, consistent with a dragging doctor. The doctor blade 32 is mounted in a mounting device 34 which, for the purpose of adjustment of the doctor blade 32 against the material web 18, may be pivoted through a drive mechanism or may be adjusted linearly. Other than that, however, mounting device 34 is designed to be stationary. That is, it is not equipped with a drive mechanism that would produce an oscillating movement in cross direction Q of material web 18. In the illustration in FIG. 1, the cross direction Q runs orthogonally to the plane of projection, that is, orthogonally to travel direction L and at each point of the web 18 in a local tangent plane, specific to each respective point of the web 18. The leveling unit 30 is not equipped with any drive mechanism other than the drive mechanism for positioning the doctor blade 32 against the material web 18. On its side facing away from the doctor blade 32, the material web 18 is routed around a back-up roll 36.

Because the material web 18 passes the doctor blade 32 in travel direction L, possible unevenness 26*a* in the coating layer 26 is eliminated or spread out without removing coating medium 16 from the material web 18. In this way, a coating layer 28 results in travel direction L following the leveling unit 30 which, compared with coating layer 26 prior to the leveling unit 30, displays a substantially smooth surface.

In order to be able to use the spreading effect of the doctor blade 32 as effectively as possible, the coating layer 26 must still possess a certain residual moisture in the area of the leveling unit 30. For this reason, the distance d of the leveling unit 30 from the point of separation 24 should be no more than approximately 200 cm. In other words, the smoothing of the coating layer 26 by use of the leveling unit 30 should take place no later than 1.0 second following separation from the surface 12*a* of transfer roll 12.

In order to be able to avoid dirt buildup on doctor blade 32, a spraying device 38 is provided prior to the leveling unit 30 relative to travel direction L of material web 18. With the help of spraying device 38, the doctor blade 32 is sprayed with small amounts of steam 40. This steam 40 settles in the form of condensate on the doctor blade 32 and prevents dirt buildup in that location. In addition, the coating layer 26 can be moistened to a certain extent by steam spraying so that it can be smoothed more easily by the doctor blade 32.

FIGS. 2 and 3 illustrate alternative embodiments of the leveling unit 30. In contrast to FIG. 1 where a "bent-blade" 32 is utilized, in the embodiments of FIGS. 2 and 3, the leveling unit 30' includes a substantially rigid doctor blade 32' which is also referred to as "stiff-blade". In other respects, the design arrangement in FIG. 2 corresponds with that in FIG. 1, and specific reference is made to that description.

In the embodiment illustrated in FIG. 3, a metering rod 32" is utilized in the leveling unit 30". Metering rod 32" has a substantially smooth surface and is driven, preferably, by a rotational drive mechanism that is not illustrated in detail here. The revolving metering rod 32" may rotate in flow direction L, as well as in the opposite direction. In addition, a cooling unit 40" is provided in mounting device 34" of metering rod 32". Cooling unit 40" cools the revolving metering rod 32" and its mounting 34". Because of the cooling effect provided by this cooling unit 40", condensate deposits are achieved on the surface of metering rod 32", which counteracts contamination build up. In other respects, the design arrangement in FIG. 3 corresponds with that in FIG. 1, and specific reference is made to that description.

In addition, or in alternative to the cooling device 40" in the embodiment illustrated in FIG. 3, a spraying device consistent with the spraying device 38 can be provided. Obviously, a cooling unit that is consistent with cooling unit 40" may also be used in addition to the spraying device 38 when a doctor blade 32 or 32' is used as per FIG. 1 or 2.

In the embodiments of the invention according to FIGS. 1, 2 and 3, the applicator unit 10 served only for one-sided indirect application of liquid or viscous medium 16 onto the material web 18. Another embodiment, illustrated in FIG. 4, includes an applicator unit 110 for applying liquid or viscous mediums 116 or 116' to both sides of a traveling material web 118. In this arrangement, the applicator unit 110 includes two applicator devices 114 and 114' which apply the coating medium 116 or 116' onto the surface 112*a* or 112*a*' of a transfer roll 112 or 112'. By rotating the transfer rolls 112 or 112' about axis A or A' in direction of arrows P or P', the operating medium is brought to a transfer nip 122 where the transfer to both sides of the material web 18 occurs.

Leveling devices 130 and 130' are arranged one on each side of material web 118 following the transfer nip 122 as viewed in travel direction L. Leveling devices 130 and 130' spread the coating layers 126 and 126', resulting in a material web 118 having smooth coating layers 128 and 128' following the leveling units 130 and 130'. In the arrangement illustrated in FIG. 4, both leveling devices 130 and 130' are equipped with a "bentblade" 132 and 132'. It is, however, to be understood that "stiff-blades" consistent with FIG. 2, or metering rods, consistent with FIG. 3 could also be utilized. In addition, it is also to be understood that the leveling units 130, 130' in FIG. 4 may also be equipped with spraying devices consistent with spraying device 38 in FIG. 1 and/or with cooling devices consistent with cooling device 40" in FIG. 3.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for indirectly applying a coating medium onto a traveling fiber material web having a direction of travel, said apparatus comprising:

a first transfer element having a surface, said first transfer element being configured for contacting the fiber web and transferring one layer of the coating medium onto the web;

an applicator unit configured for applying the one layer of the coating medium onto said surface of said first transfer element;

a first leveling unit disposed after said first transfer element relative to the direction of travel of the fiber web, said first leveling unit including a rigidly mounted first leveling element extending in a cross direction substantially orthogonal to the direction of travel of the fiber web, said first leveling element being configured for contacting the fiber web and smoothing the one layer of the coating medium on the fiber web; and a moistening device disposed prior to said first leveling element relative to the direction of travel of the fiber web and configured for moistening said first leveling element, said moistening device comprising a spray device configured for spraying said first leveling element with steam.

2. The apparatus of claim 1, wherein said first leveling element includes one of a metering rod with a substantially smooth surface and a cooled roll with a substantially smooth surface.

3. The apparatus of claim 1, wherein said first leveling element includes a dragging doctor blade.

4. The apparatus of claim 3, wherein said dragging doctor blade is configured for deflecting upon contact with the fiber web.

5. The apparatus of claim 1, wherein said first leveling element is configured for smoothing the one layer of the coating medium on the fiber web substantially without removing any of the coating medium from the fiber web.

6. The apparatus of claim 1, further comprising a backing roll associated with said first leveling unit, said backing roll being configured for supporting the fiber web.

7. The apparatus of claim 1, wherein said first leveling unit includes:

a mounting configured for receiving said first leveling element; and a cooling device configured for cooling said first leveling element and said mounting.

8. The apparatus of claim 1, wherein said first transfer element includes a point of separation from the fiber web, said first leveling unit being disposed approximately between 50 cm and 200 cm after said point of separation relative to the direction of travel of the fiber web.

9. The apparatus of claim 1, wherein a travel time of the fiber web between said first transfer element and said first leveling unit is between 0.01 second and 1.0 second.

10. The apparatus of claim 1, wherein said first transfer element comprises a transfer roll having a circumference, said transfer roll being configured for having the fiber web at least partially wrapped around said circumference.

11. The apparatus of claim 1, further comprising a backing roll opposing said first transfer element, said backing roll being configured for being disposed on a side of the fiber web opposite said first transfer element.

12. The apparatus of claim 11, wherein a line pressure force between said first transfer element and said backing roll is approximately between 2 kN/m and 30 kN/m.

13. The apparatus of claim 1, further comprising a second transfer element opposing said first transfer element, said second transfer element being configured for being disposed on a side of the fiber web opposite said first transfer element, said second transfer element also being configured for indirectly applying the coating medium.

14. The apparatus of claim 13, further comprising a second leveling unit disposed after said second transfer element relative to the direction of travel of the fiber web.

15. The apparatus of claim 14, wherein said second leveling unit includes a second leveling element configured for supporting said first leveling element.

16. An apparatus for indirectly applying a coating medium onto a traveling fiber material web having a direction of travel, said apparatus comprising:

a first transfer element having a surface, said first transfer element being configured for contacting the fiber web and transferring one layer of the coating medium onto the web;

an applicator unit configured for applying the one layer of the coating medium onto said surface of said first transfer element, a first leveling unit disposed after said first transfer element relative to the direction of travel of the fiber web, said first leveling unit including a rigidly mounted first leveling element extending in a cross direction substantially orthogonal to the direction of travel of the fiber web, said first leveling element being a first doctor blade configured for contacting the fiber web and smoothing the one layer of the coating medium on the fiber web;

a first moistening device disposed prior to said first leveling element relative to the direction of travel of the fiber web and configured for moistening said first leveling element, said moistening device comprising a spray device configured for spraying said first leveling element with steam;

a second transfer element opposing said first transfer element, said second transfer element being configured for being disposed on a side of the fiber web opposite said first transfer element, said second transfer element also being configured for indirectly applying the coating medium;

a second leveling unit disposed after said second transfer element relative to the direction of travel of the fiber web, said second leveling element includes a second leveling element configured for supporting said first leveling element, said second leveling element being a second doctor blade positioned so as to opposed said first doctor blade; and a second moistening device disposed prior to said second leveling unit relative to the direction of travel of the fiber web and configured for moistening said second leveling element, said moistening device comprising a spray device configured for spraying said second leveling element with steam.

* * * * *

UNITED STATES PATENT AND TRADEMARK OFFICE

CERTIFICATE OF CORRECTION

PATENT NO. : 6,126,750

DATED : October 3, 2000

INVENTOR(S) : Roland Seiz et al.

It is certified that error appears in the above-identified patent and that said Letters Patent is hereby corrected as shown below:

Column 4

Line 61, delete "FIG." and substitute -FIGS.- therefor

Column 5

Line 17, delete "bentblade" and substitute -bent-blade- therefor.

Column 8

Line 12, add --17. The apparatus of claim 7, wherein said dragging doctor blade is substantially rigid.--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*